United States Patent [19]

Sepavich et al.

[11] 4,095,620

[45] Jun. 20, 1978

[54] PROJECTILE FOR WEFT INSERTION

[75] Inventors: Victor F. Sepavich, West Boylston; Petras Cyvas, Worcester, both of Mass.

[73] Assignee: Crompton & Knowles Corporation, New York, N.Y.

[21] Appl. No.: 837,346

[22] Filed: Sep. 28, 1977

[51] Int. Cl.[2] ..... D03J 5/06

[52] U.S. Cl. ..... 139/196.2

[58] Field of Search ..... 139/437, 438, 439, 196.2

[56] References Cited

U.S. PATENT DOCUMENTS

| | | | |
|---|---|---|---|
| 3,395,737 | 8/1968 | Wueger | 139/437 |
| 3,831,640 | 8/1974 | Wueger | 139/437 |
| 4,046,174 | 9/1977 | Wueger | 139/437 |

FOREIGN PATENT DOCUMENTS

| | | | |
|---|---|---|---|
| 223,143 | 1/1962 | Austria | 139/436 |
| 82,678 | 6/1971 | Germany | 139/196.2 |
| 1,033,060 | 6/1966 | United Kingdom | 139/437 |
| 1,081,404 | 8/1967 | United Kingdom | 139/437 |
| 1,098,802 | 1/1968 | United Kingdom | 139/439 |

*Primary Examiner*—Henry S. Jaudon

*Attorney, Agent, or Firm*—Howard G. Garner

[57] ABSTRACT

A projectile for use in an outside filling supply loom in which at least a portion of a filling pick is inserted into the projectile prior to each weft insertion. The projectile comprises a weft storage chamber having an inlet opening at one end through which the filling is inserted into the chamber, an outlet opening at the opposite end of the projectile and an air passageway from the storage chamber to the outlet opening which by-passes the filling stored within the chamber so that airflow between the inlet and outlet ends does not affect the filling stored within the chamber.

17 Claims, 6 Drawing Figures

FIG. 1
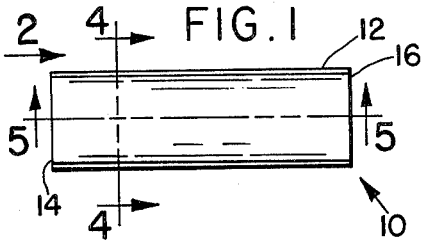
FIG. 2
FIG. 3
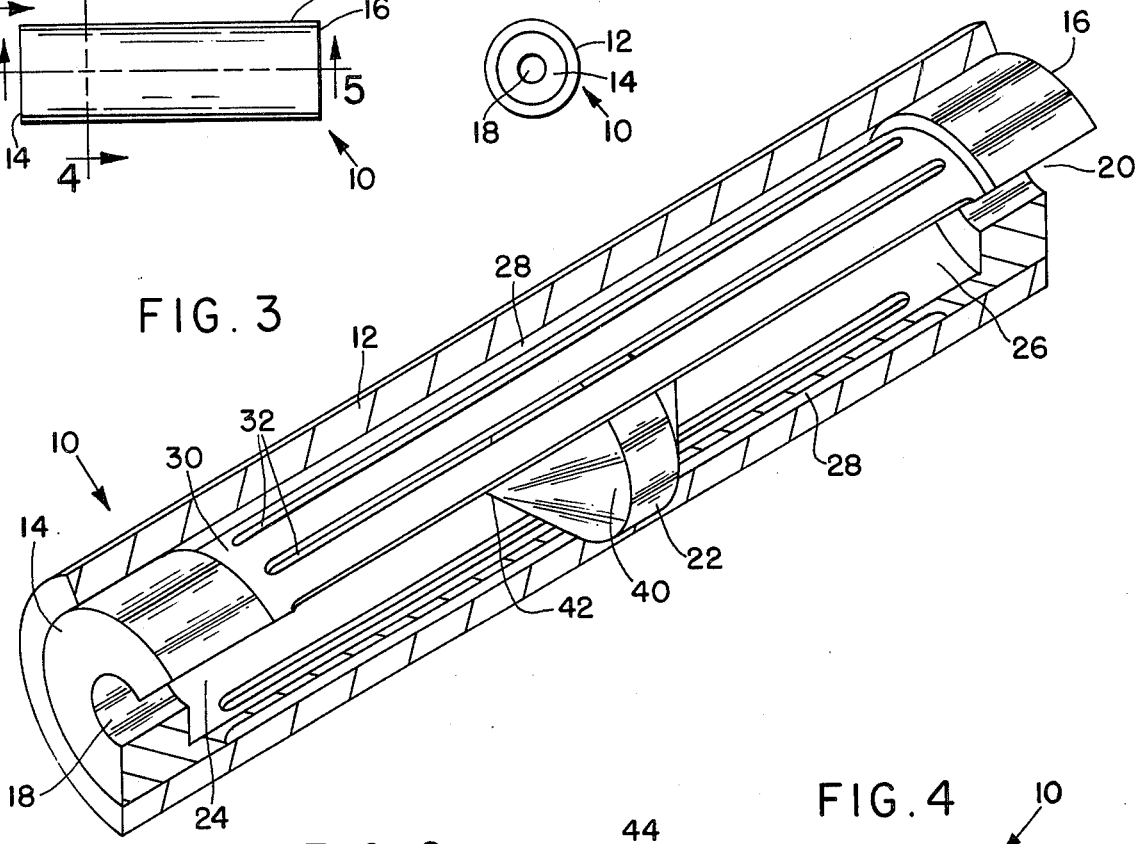
FIG. 6
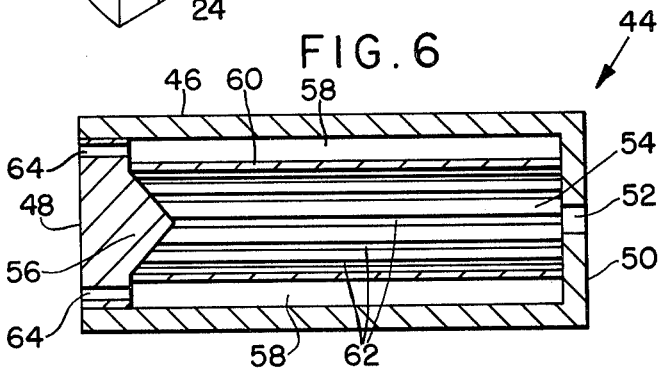
FIG. 4
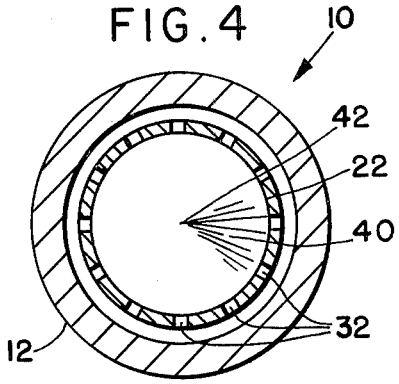
FIG. 5
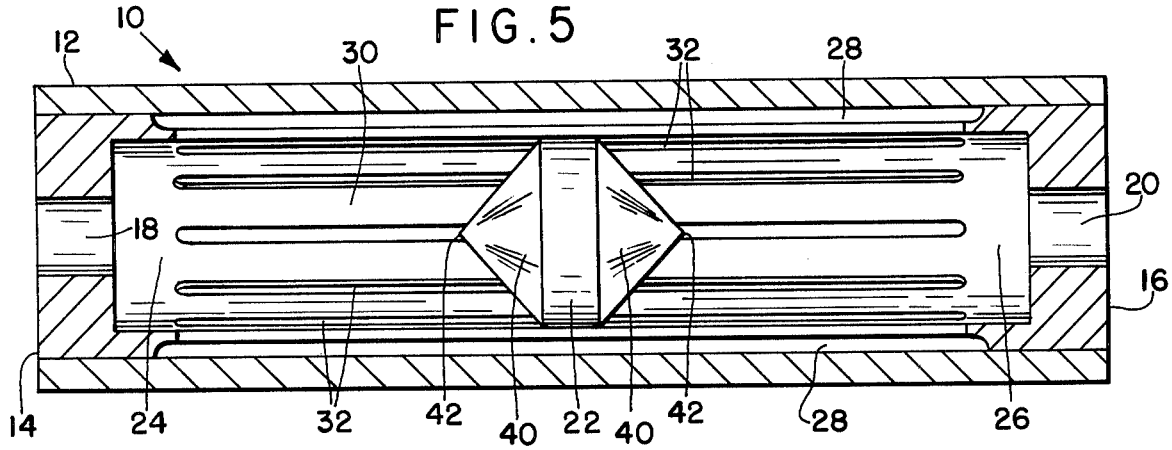

PROJECTILE FOR WEFT INSERTION

BACKGROUND OF THE INVENTION

This invention relates generally to projectiles for inserting a weft yarn in a loom wherein the weft yarn is supplied from supply packages located outside of the loom. The invention is particularly directed to a projectile of the type wherein at least a portion of the weft yarn is stored within a weft storage chamber within the projectile. This type of projectile and the loom for which it is used is shown in U.S. Pat. No. 3,831,640 to Karl W. Wueger dated Aug. 27, 1974. The projectile disclosed in this U.S. patent is designed for firing from each side of the loom alternately. For this reason there is a storage chamber located at each end of the projectile and means are provided to allow air to pass freely from one end of the projectile to the other. This aids in depositing the weft yarn in the storage chamber.

Under certain operating conditions, projectiles of the design shown in U.S. Pat. No. 3,831,640 have had problems in maintaining the weft stored in the weft storage chamber during the flight of the projectile through the shed. For certain lengths of sheds and certain velocities of the projectile, air entering the leading end of the projectile during flight, passes through the projectile and tends to blow the weft yarn stored in the chamber at the trailing end of the projectile out of the projectile. This yarn stored in the projectile is destined eventually to be withdrawn from the projectile as part of the weft inserting operation, but unfortunately the air stream causes the stored weft yarn therein to be blown out prematurely and thereby deposit this stored yarn in a bunch or snarl within the shed. This produces a defective pick and of course defective cloth produced by the loom. Difficulties have also been encountered in loading the projectile. As the filling is deposited into the storage chamber, it tends to settle against the outlet openings of the chamber and block the openings. This reduces the air flow through the projectile and interfers with the depositing of additional filling.

BRIEF SUMMARY OF THE INVENTION

It is a principal object of the present invention to provide a projectile which overcomes all of the disadvantages of the projectiles of the type shown in the above-identified U.S. patent. The present invention is directed to a projectile design which will prevent the stored weft yarn from being blown out of the weft storage chamber prematurely during its flight through the warp shed and to enable filling to be deposited in the storage chamber without difficulties. The object of the invention is accomplished by a shuttle design which includes a weft storage chamber which has an inlet opening at one end through which the weft yarn may be deposited within the weft storage chamber. The projectile also has the feature of an air passageway from the weft storage chamber through the projectile to an outlet opening at the other end of the projectile. However, this air passageway is designed in such a manner as to cause an air stream passing through the projectile to be diverted from contact with the stored weft itself. The projectile of the present invention allows a free flow of air through the projectile during loading of the weft yarn within the storage chamber and during the flight of the projectile through the warp shed but prevents this flow of air during shuttle flight from influencing the weft in the storage chamber and prevents it from being blown out into the warp shed at a premature point in the weaving cycle. In the preferred embodiment of the present invention, the projectile has a weft storage chamber at both ends thereof to enable it to be used for weft insertion from both sides of the loom alternately. In this particular design, the inlet opening of one chamber also functions as the outlet opening of the other chamber. The present projectile design is such that unlike previous projectile designs where air flow goes directly from one chamber to the other chamber, the air flow is diverted from one weft storage chamber into a passageway which by-passes the section of the projectile which separates the two weft storage chambers and is connected to the other weft storage chamber.

BRIEF DESCRIPTION OF THE DRAWINGS

The present invention will be understood more clearly from the following description when read together with the drawings in which:

FIG. 1 is an elevation of the projectile of the present invention showing the outside configuration thereof;

FIG. 2 is an end view of the projectile looking in the direction of arrow 2 FIG. 1;

FIG. 3 is a perspective of the projectile shown in FIG. 1 on an enlarged scale with portions broken away;

FIG. 4 is a vertical section taken along line 4—4 of FIG. 1;

FIG. 5 is a longitudinal section taken along line 5—5 of FIG. 1; and FIG. 6 is a diagrammatic section of a modified projectile designed for weft insertion from one side of the loom only.

DETAILED DESCRIPTION OF THE INVENTION

Referring particularly to FIGS. 1 and 2, the preferred embodiment of the novel projectile is generally indicated by the reference numeral 10 and includes an elongated cylindrical body having an outer surface 12 and flat ends 14 and 16. End 14 has an opening 18 therein as shown in FIG. 2 and end 16 has an opening 20, see FIGS. 3 and 5. Openings 18 and 20 represent the ends of a bore which extends through the center of the projectile and which is divided by central partition 22 into 2 weft storage chambers 24 and 26 adjacent ends 14 and 16, respectively. An annular channel 28 surrounds chambers 24 and 26 and are separated therefrom by an annular wall 30 which contains a plurality of elongated slots 32 connecting chambers 24 and 26 to passageway 28. Each side of partition 22 contains a conically shaped proturberance 40 having an apex 42 which extends into the adjacent weft storage chamber. Conical protuberance 40 helps to insure that the weft yarn is deposited within the storage chamber in coils. Yarn is deposited within the storage chambers 24 and 26 by any conventional means such as, for example, the pneumatic inserting means disclosed in U.S. Pat. No. 3,831,640 described above.

During utilization of the projectile disclosed in FIGS. 1 through 5 in a loom such as that shown in the above-identified U.S. patent, weft yarn is inserted in storage chamber 26 when the projectile is boxed at the right side of the loom. The weft is introduced into chamber 26 through opening 20 and is, in accordance with the method disclosed in the above U.S. patent, disposed within chamber 26 in loose spiral coils. Weft yarn may be easily introduced by a blast of air since the air is allowed to pass through slots 32 into passageway 28 and exit through slots 32 into passageway 24 and out through opening 18. When the projectile is picked toward the left side of the loom through the warp shed, air will enter chamber 24 through opening 18 and pass through slots 32 into passageway 28. This air will then pass from passageway 28 into chamber 26 through slots 32 and out through opening 20. Although air passing through slots 32 may impinge somewhat on the weft yarn within chamber 26, most of the weft yarn will be packed against the proturberance 40 and will escape the effects of the air stream. In addition, the air is more likely to pass through the portions of the slots 32 which are unobstructed by the weft yarn within the storage chamber 26. As the projectile proceeds through the warp shed, the weft yarn stored within chamber 26 under control of devices associated with the picking mechanism is deposited within the warp shed. These devices form no part of the present invention but the projectile of the present invention allows these devices to control the exit of the weft yarn without interference from the air flow through the projectile itself.

When the projectile reaches the left side of the loom, weft yarn is stored or deposited within chamber 24 and the projectile is then picked toward the right side of the loom in the same manner as when it was picked from the right side of the loom. Since the projectile is symmetrical, the aerodynamic effects will be the same whether it's picked from the right or the left side of the loom.

MODIFIED PROJECTILE

Referring particularly to FIG. 6 there is shown a modified projectile generally indicated by the reference numeral 44. This modified projectile incorporates the inventive concepts of the present invention in a design intended for use in a loom wherein filling picks are inserted from only one side of the loom. In looms of this type, the projectile is picked from one side, boxed on the opposite side and then conveyed back to the side where firing occurs. When this concept is employed, several projectiles are used during the course of weaving. Projectile 44 has an elongated cylindrical body having an outer surface 46 and flat ends 48 and 50. End 50 contains an opening 52 which leads into a weft storage chamber 54 within the center of projectile 44. The opposite end of chamber 54 adjacent end 48 has a conically shaped protuberance 56 similar to protuberance 40 in the preferred embodiment and is employed for the same purpose as protuberance 40. An annular passageway 58 surrounds storage chamber 54 and is separated therefrom by a partition 60. Elongated slots 62 are located in partition 60 and pneumatically connect passageway 58 to weft storage chamber 54. Weft yarn is pneumatically inserted within storage chamber 54 through opening 52 and air is allowed to escape from chamber 54 into passageway 58 and out of the projectile through openings 64 and end 48 of the projectile. One or more openings may be employed as an outlet for the air as desired. When projectile 44 is utilized for weft insertion in an outside filling supply loom, weft is inserted in chamber 54 through opening 52 and projectile 44 is picked toward the left as viewed in FIG. 6. During its flight through the warp shed, air enters into passageway 58 through opening 64 and thereafter passes into storage chamber 54 through slots 62 and finally out through the projectile through opening 52. As in the case of the preferred embodiment, the passage of air through the projectile will not effect the yarn which is stored within storage chamber 54 and will not interfere with the normal operation of the weft control mechanism which allows the weft yarn to be deposited in the warp shed.

I claim:

1. A projectile for use in a loom in which filling picks are inserted from an outside supply source comprising:
(a) an elongated body having an inlet opening at one end and an outlet opening at the opposite end thereof;
(b) an outer wall defining the outer configuration of said body;
(c) an inner wall defining a filling storage chamber within said body, said storage chamber being connected to said inlet opening;
(d) a passageway located between said outer wall and said inner wall and connected to said outlet opening; and
(e) at least one aperture in said inner wall for connecting said storage chamber to said passageway.

2. The projectile as set forth in claim 1 wherein said body is cylindrical.

3. The projectile as set forth in claim 1 wherein there are a plurality of apertures.

4. The projectile as set forth in claim 3 wherein said apertures are elongated and extend along the entire length of said storage chamber.

5. The projectile as set forth in claim 1 wherein said storage chamber is cylindrical.

6. The projectile as set forth in claim 5 comprising a conical protruberance the base of which is located at the interior end of said storage chamber.

7. The projectile as set forth in claim 1 wherein said passageway circumscribes said storage chamber.

8. A projectile for use in a loom in which filling picks are inserted from an outside supply source comprising:
(a) a body having an inlet opening at one end, and an outlet opening at the opposite thereof;
(b) an outer wall defining the outer configuration of said body;
(c) an inner wall defining a filling storage chamber and defining with said outer wall a passageway, said storage chamber being connected to said inlet opening and said passageway being connected to said outlet opening; and
(d) at least one aperture in said inner wall connecting said passageway to said storage chamber, whereby air will be permitted to flow from said inlet opening into said storage chamber, through said aperture into said passageway and out through said outlet opening.

9. The projectile as set forth in claim 1 wherein said body is cylindrical.

10. The projectile as set forth in claim 1 wherein said passageway circumscribes said storage chamber.

11. The projectile as set forth in claim 3 wherein there are a plurality of apertures.

12. The projectile as set forth in claim 11 wherein said apertures are elongated and extend along the entire length of said storage chamber.

13. A projectile for use in a loom in which filling picks are inserted from an outside supply source comprising:
(a) an elongated body;
(b) a central bore extending along the central longitudinal axis of said body and including an inlet opening at each end of said body;

(c) a partition at the center of said body separating said bore into two separate filling storage chambers;

(d) a passageway located between said bore and the outer surface of said body; and (e) at least one aperture connecting each of said storage chambers with said passageway.

14. The projectile as set forth in claim 13 wherein said bore is cylindrical.

15. The projectile as set forth in claim 13 wherein said passageway is annular and circumscribes said bore.

16. The projectile as set forth in claim 13 wherein there are a plurality of apertures connecting each of said storage chambers to said passageway.

17. The projectile as set forth in claim 13 wherein said apertures are elongated and extend along most of the length of said bore.

* * * * *